US006360848B1

(12) United States Patent
Barth

(10) Patent No.: US 6,360,848 B1
(45) Date of Patent: Mar. 26, 2002

(54) SAFETY SYSTEM FOR A VERTICAL RECIPROCATING CONVEYOR

(75) Inventor: Gene M. Barth, Glendale, WI (US)

(73) Assignee: Pflow Industries, Inc., Milwaukee, WI (US)

( * ) Notice: Subject to any disclaimer, the term of this patent is extended or adjusted under 35 U.S.C. 154(b) by 0 days.

(21) Appl. No.: 09/602,396

(22) Filed: Jun. 23, 2000

(51) Int. Cl.[7] ..... B66B 5/04
(52) U.S. Cl. ..... 187/373; 74/1.5
(58) Field of Search ..... 187/373, 374, 187/375, 376; 74/1.5

(56) References Cited

U.S. PATENT DOCUMENTS

| | | | | | |
|---|---|---|---|---|---|
| 228,107 | A | | 5/1880 | Otis | |
| 253,695 | A | | 2/1882 | Hafner | |
| 493,724 | A | * | 3/1893 | Hultgren | |
| 601,536 | A | | 3/1898 | Taylor | |
| 740,566 | A | | 10/1903 | Holger | |
| 890,797 | A | * | 6/1908 | Rice | |
| 943,523 | A | * | 12/1909 | Cunningham | |
| 1,581,459 | A | | 4/1926 | Lindquist | |
| 1,871,213 | A | | 8/1932 | Dunlop | |
| 2,145,656 | A | | 1/1939 | Hymans | 187/90 |
| 3,232,382 | A | * | 2/1966 | Buck | |
| 4,089,391 | A | | 5/1978 | Schill | 187/12 |
| 5,228,537 | A | | 7/1993 | Pfleger et al. | 187/8.5 |
| 5,908,088 | A | | 1/1999 | Webster et al. | 187/274 |

OTHER PUBLICATIONS

"Pflow Vertical Lifts", Pflow Industries brochure, 1999.
"Pflow Vertical Lifts" Owner's Manual, Series M, Pflow Industries, 1998.

* cited by examiner

*Primary Examiner*—Thomas J. Brahan
(74) *Attorney, Agent, or Firm*—Andurs, Sceales, Starke & Sawall

(57) ABSTRACT

A vertical reciprocating conveyor having a safety mechanism for automatically locking the carriage of the conveyor at an elevated level upon uncontrolled vertical movement of the carriage. The conveyor includes a safety mechanism having a locking device mounted onto the movable carriage. The locking device includes a safety cam that is movable between an engaging position and a non-engaging position, such that when the safety cam is in the engaging position, the safety cam prevents the carriage from moving along the vertical support columns. The safety mechanism further includes a speed-sensing device that detects the speed of vertical movement of the carriage. When the speed of the conveyor exceeds an upper speed limit, the speed-sensing device releases the locking device. The speed-sensing device includes a cylindrical housing having a weighted shaft that slides into and out of the housing. When the housing rotates at an elevated speed, the weighted shaft remains extended from the housing and contacts an abutment and releases the safety cam of the locking device.

25 Claims, 4 Drawing Sheets

SAFETY SYSTEM FOR A VERTICAL RECIPROCATING CONVEYOR

BACKGROUND OF THE INVENTION

The present invention relates to a safety mechanism for use on a vertical reciprocating conveyor that moves cargo between two or more different vertical levels. More specifically, the present invention relates to a safety mechanism that is operable to lock the carriage of the vertical reciprocating conveyor in a fixed vertical position when the vertical speed of the carriage exceeds a preselected upper speed limit due to an uncontrolled descent of the carriage.

A typical vertical reciprocating conveyor includes a carriage having a platform to support cargo as the carriage is guided for vertical movement on a supporting structure or frame that includes at least a pair of vertical support columns. A typical mechanically operated vertical conveyor includes an electric motor that is connected through a lift chain to the carriage. Operation of the reversible electric motor acts on the lift chain to raise and lower the carriage along the spaced vertical support columns. When the carriage reaches a desired vertical level, a braking mechanism included in the electric drive motor locks the motor in place and prevents further rotation of the lift chain and thus prevent descent of the carriage due to gravity.

It has been recognized that unintentional descent of the carriage from an elevated level can create a severe safety hazard. Unintentional descent of the carriage can be the result of overloading the carriage, either intentionally or inadvertently, beyond its rated capacity. One type of possible failure in the lifting mechanism for the carriage is the complete failure of the lift chain used to lift the carriage between the upper and lower levels.

In the past, attempts have been made to include a safety mechanism with the vertical conveyor to provide protection against uncontrolled descent of the carriage. For example, one type of prior art safety mechanism includes a safety cam that is held in a non-engaging release position by the weight of the carriage acting on the lift chain. If the lift chain fails, the release of the weight of the carriage on the lift chain allows a torsion spring to urge the safety cam into a locking position and engage one of the vertical uprights forming the frame of the vertical conveyor. The mechanical interaction between the safety cam and one of the vertical supports locks the carriage in a stationary position to prevent further uncontrolled descent of the carriage.

Although the safety mechanism described above functions well if the uncontrolled descent of the carriage is due to a failure in the lift chain, other types of failure in the conveyor can also cause uncontrolled descent of the carriage. For example, the most likely type of failure in the conveyor that would cause an uncontrolled descent is a failure in the braking mechanism of the drive motor. If the braking mechanism fails, the carriage can fall from an elevated position although no damage has been done to the lift chain. If the braking mechanism fails, tension will remain in the lift chain and the safety mechanism described above will not activate to prevent uncontrolled descent of the carriage.

Therefore, it is an object of the present invention to provide a vertical-reciprocating conveyor that includes a safety mechanism that prevents uncontrolled vertical movement of the carriage. Further, it is an object of the present invention to provide a safety mechanism that prevents uncontrolled movement of the carriage when the speed of the carriage exceeds a predetermined, upper speed limit. It is an additional object of the present invention to provide a safety mechanism that includes a locking device that is released from a non-engaging position to an engaging position when the speed of the carriage exceeds the upper speed limit. Additionally, it is an object of the invention to provide a safety mechanism that includes a speed-sensing device that acts as an escapement that has a fail-safe mode of operation.

SUMMARY OF THE INVENTION

The present invention is directed to a safety mechanism for automatically locking a vertical reciprocating conveyor at an elevated level upon detection of an uncontrolled descent of the carriage. The vertical reciprocating conveyor includes a carriage having a loading deck adapted to support a load or cargo. The carriage is guided for vertical movement between at least a pair of vertical support columns. The carriage is moved between at least an upper and a lower level by a drive mechanism that includes a reversible drive motor connected to the carriage by at least a pair of lift chains.

The safety mechanism of the present invention includes a locking device mounted to each side frame member of the carriage. Each locking device includes a cam that is rotatably movable between a non-engaging position and an engaging position. The cam is biased into the engaging position by a torsion spring. When the cam is in the engaging position, a series of serrated teeth on the cam engage an inside wall of one of the vertical support columns to lock the carriage in a vertical position.

The cam of the locking device is normally held in its non-engaging position by an engagement pin. The engagement pin contacts a portion of the cam to hold the cam in the non-engaging position against the bias force generated by the torsion spring. When the cam is in the non-engaging position, the carriage is freely movable along the spaced vertical support columns.

The safety mechanism further includes a speed-sensing device positioned to detect the speed of vertical movement of the carriage and is operable to release the locking device from the non-engaging position to the engaging position when the speed of the carriage exceeds a predetermined upper speed limit. The speed-sensing device includes a hollow, tubular housing and a sprocket mounted to a common shaft that is rotated by a safety chain that passes around the sprocket and is connected to the moving carriage. As the carriage moves vertically along the vertical support columns, the safety chain rotates the sprocket, the shaft and the attached tubular housing at a speed directly proportional to the vertical speed of the carriage.

A weighted shaft is positioned within the tubular housing and includes a pair of end caps connected to opposite ends of the weighted shaft. The end caps attached to each end of the weighted shaft are larger than the diameter of the tubular housing such that the weighted shaft is entrapped within the tubular housing. The movement of the weighted shaft into and out of the hollow housing is limited by each of the end caps.

A abutment is spaced above the rotating tubular housing by a distance sufficient to allow the tubular housing and weighted shaft to rotate beneath the abutment during the normal operating condition of the vertical reciprocating conveyor. As the speed-sensing device rotates, the force of gravity causes the weighted shaft to move into and out of the hollow housing. During the normal operating conditions, the and cap attached to the weighted shaft passes beneath the abutment which allows the housing and sprocket to freely rotate.

When the speed of the carriage increases, the weighted shaft remains extended from the tubular housing as the extended portion of the weighted shaft rotates past a horizontal equator extending through the rotational axis for the housing. The speed-sensing device is designed such that when the speed of rotation of the sprocket and tubular housing exceeds a preselected upper speed limit, the weighted shaft contacts the abutment and prevents further rotation of the sprocket.

The speed sensing device acts as an escapement that has a fail-safe mode of operation. Since the weighted shaft must move into the hollow housing before passing beneath the abutment, the escapement must be operating properly in order for the carriage to continue moving along the vertical support columns. If the escapement fails, the weighted shaft will remain extended from one end of the tubular housing and thus contact the abutment during normal operation of the vertical reciprocating conveyor. Thus, if the escapement fails, the weighted shaft will contact the abutment and prevent further rotation of the sprocket.

When the rotation of the sprocket is stopped, the safety chain can no longer move with the falling carriage. When the safety chain is prevented from moving, the safety chain applies an upward force to the engagement pin holding the cam of the locking device in its non-engaging position. When the engagement pin is pulled upward by the safety chain, the cam is released and the bias force created by the torsion spring moves the cam into its engaging position. When in the engaging position, the serrated teeth formed on the cam engage an inside wall of one of these vertical support columns and locks the carriage in a stationary, vertical position.

The safety mechanism of the invention triggers operation of the locking device by detecting the speed of movement of the carriage. The uncontrolled descent of the carriage along the vertical support columns can be caused by several types of failures within the vertical reciprocating conveyor. For example, failure of the lift chains or failure of the braking mechanism in the drive motor can cause uncontrolled descent of the carriage, which then triggers the locking device. Therefore, the present invention activates the safety mechanism not only upon breakage of the lift chain but also upon failure of the braking mechanism in the drive motor.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
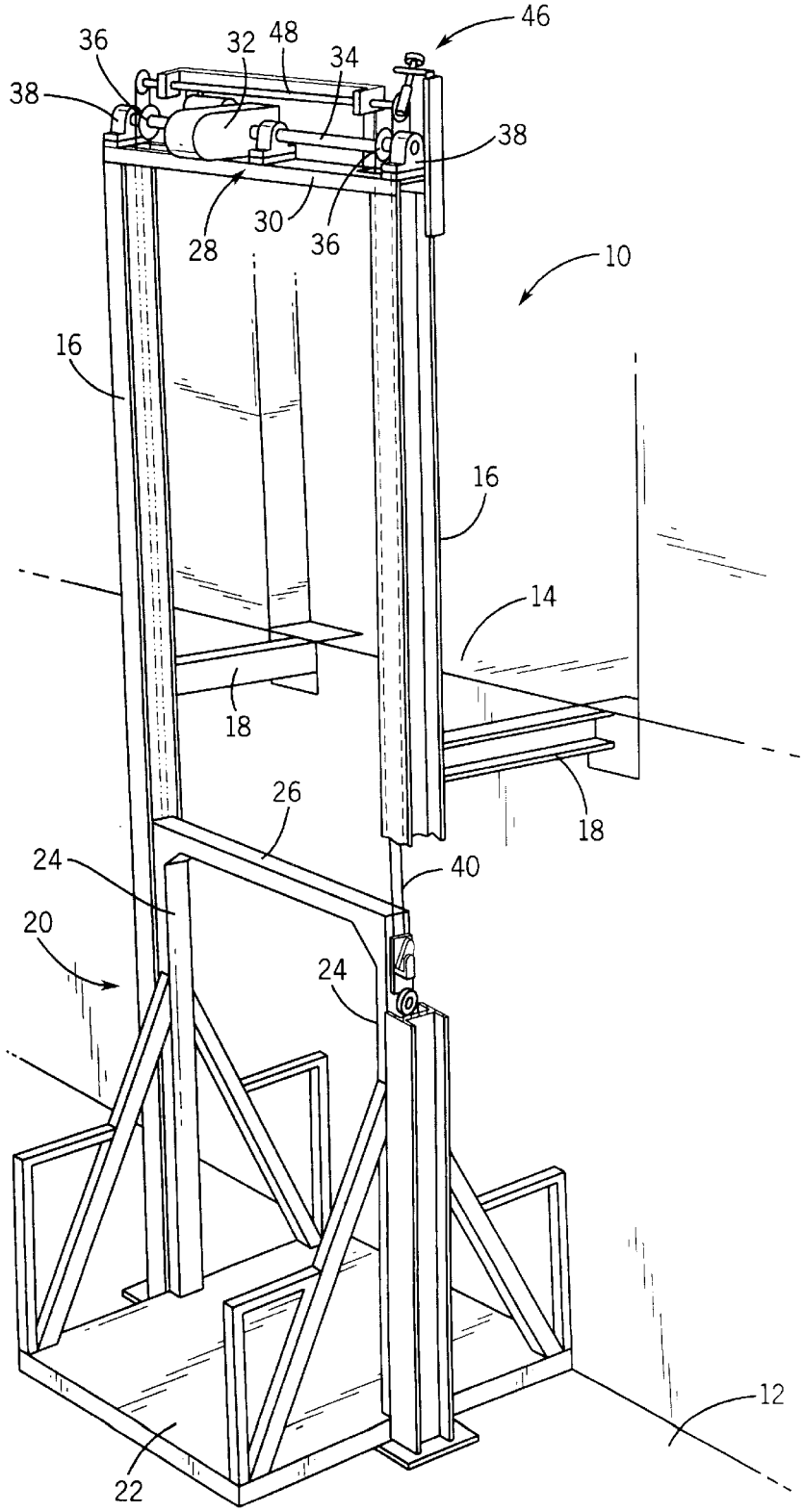
FIG. 1 is a perspective view illustrating the safety mechanism of the present invention as installed on a vertical reciprocating conveyor.

Referring first to FIG. 1, thereshown is a vertical reciprocating conveyor that is adapted to convey cargo between a lower level 12 and an upper level 14 of a building. The conveyor 10 includes a frame that consists of a pair of spaced vertical support columns 16 that are stabilized by braces 18 connecting the vertical support columns 16 with a wall of the building. Although the preferred embodiment of the invention is shown with a conveyor 10 having a pair of support columns 16, it is contemplated that the invention could be used with a four or six column conveyor.

The conveyor 10 includes a carriage 20 that is adapted to move vertically relative to the vertical support columns 16 between the lower level 12 and the upper level 14. The carriage 20 includes a deck 22 that is adapted to support a load or cargo and a pair of side frames 24 that extend upwardly from opposite sides of the deck 22. The upper ends of the side frames 24 are connected by a cross brace 26.

The carriage 20 is moved between the lower level 12 and the upper level 14 by a drive mechanism 28 that is mounted on a header 30 extending between the spaced vertical support columns 16. In the embodiment in the invention illustrated, the drive mechanism 28 includes an electric drive motor 32 mounted to the header 30. The electric drive motor 32 is operable in both a forward and a reverse direction such that the drive mechanism 28 can raise and lower the carriage 20.

The drive motor 32 is operatively connected to a drive shaft 34 that includes a pair of spaced lift sprockets 36. The drive shaft 34 is journaled within a pair of spaced bearings 38, also mounted to the header 30.

Figure 4:
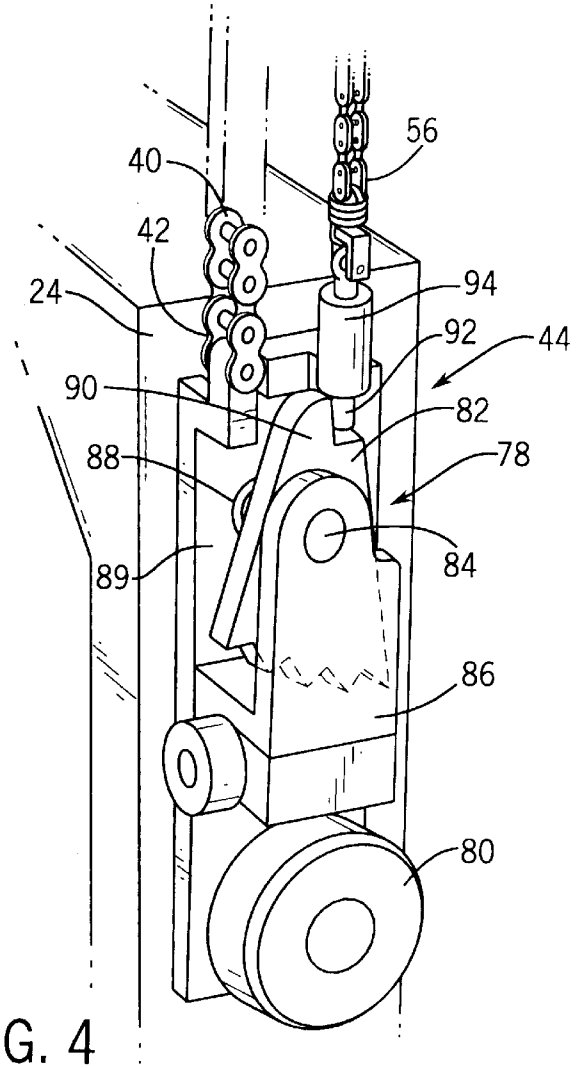
FIG. 4 is an enlarged perspective view illustrating a locking device of the safety mechanism in its non-engaging position.

A lift chain 40 passes around each of the lift sprockets 36 and each lift chain 40 has its first end 42 fixed to a wheel block assembly 44 attached to the side frame 24 of the carriage 20, as best illustrated in FIG. 4. The second end of the lift chain 40 passes over the lift sprocket 36 and extends down the outside of the vertical support column 16. A smaller chain is attached to the second end of the lift chain and passes around a chain tensioner assembly (not shown) located near the base of the vertical support column 16. The second end of the lift chain 40 terminates with a connection to the wheel block assembly 44.

When the drive motor 32 is operated, it rotates the drive shaft 34, which rotates the attached lift sprockets 36. The lift sprockets 36, in tum, move the lift chains 40, which results in upward or downward movement of the carriage 20 relative to the vertical support columns 16.

When the carriage 20 has reached the desired vertical level, a braking mechanism within the drive motor 32 prevents further rotation of the drive shaft 30 and thus holds the carriage 20 in the selected vertical position.

Figure 3:
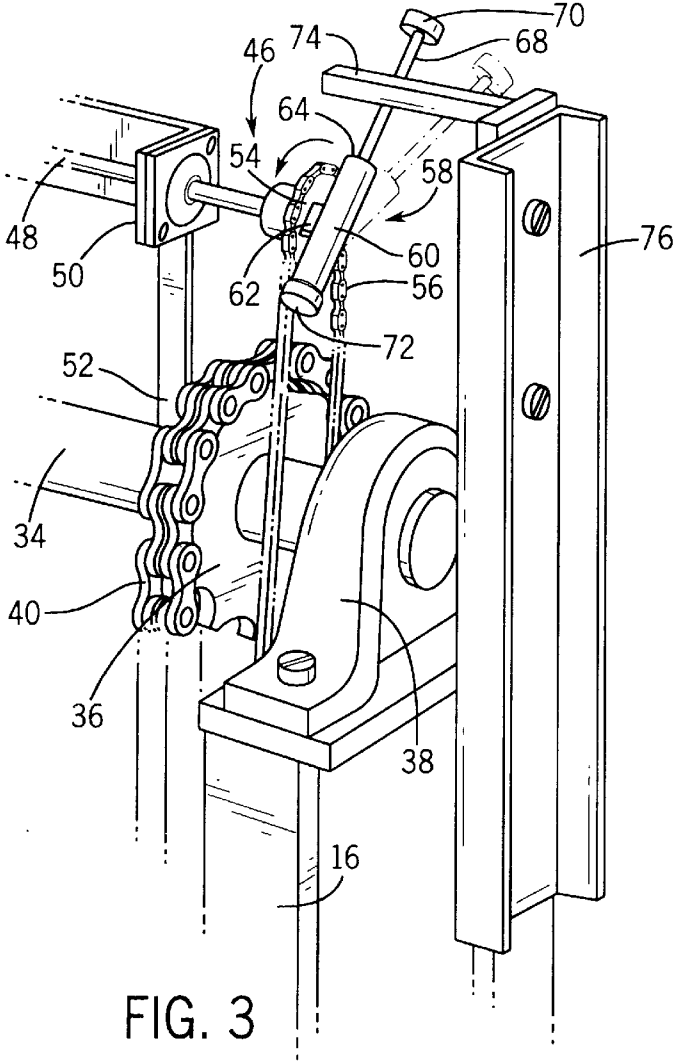
FIG. 3 is a perspective view similar to FIG. 2 illustrating the operation of the speed-sensing device to prevent further movement of the carriage along the vertical conveyor frame.
Figure 2:
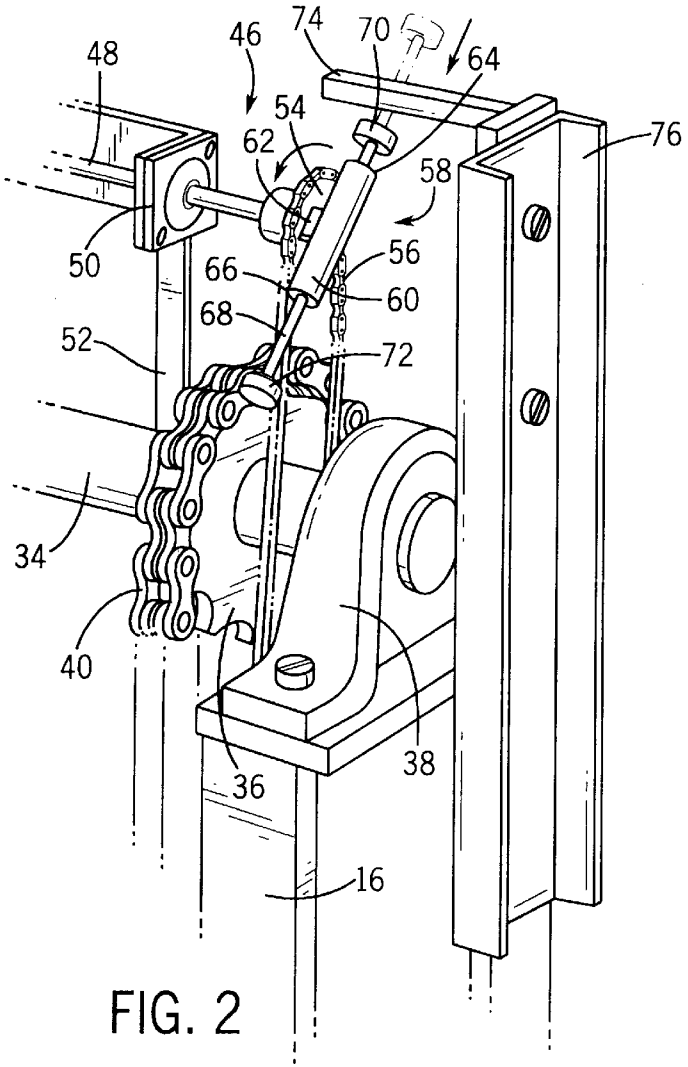
FIG. 2 is a magnified perspective view illustrating the speed-sensing device of the safety mechanism of the present invention during normal operating conditions.

The vertical reciprocating conveyor 10 of the present invention includes a safety mechanism 46 that is adapted to lock the carriage 20 at a fixed vertical level along the vertical support columns 16 upon detection of an uncontrolled descent of the carriage 20. Referring now to FIGS. 2 and 3, the safety mechanism 46 includes a transverse shaft 48 rotatably supported by a pair of mounting brackets 50 positioned above the header 30 by a pair of vertical supports 52. Each end of the shaft 48 includes a sprocket 54 that receives a safety chain 56. The safety chain 56 passes around each side of the drive shaft 34 and one end is connected to the engagement pin 92 and the other end to the lift chain 40. Thus, as the carriage 20 moves vertically, the safety chain 56 moves around the sprocket 54 which causes the sprocket 54 to rotate at a speed directly proportional to the speed of the carriage.

The safety mechanism 46 includes a speed-sensing device 58 mounted to the shaft 48 to sense the speed at which the shaft 48 and attached sprocket 54 are rotating. As discussed above, the rotational speed of the sprocket 54 is directly proportional to the speed of ascent/descent of the carriage 20 due to the safety chain 56. In the embodiment of the invention illustrated in FIGS. 2 and 3, the speed-sensing device 58 includes a housing 60 attached to the shaft 48. Specifically, the housing 60 is a hollow, cylindrical tube extending between a first end 64 and second end 66.

The tubular housing 60 receives a weighted shaft 68 that extends through the hollow, open interior of the housing 60 and is freely movable therein. The weighted shaft 68 includes a first weighted end cap 70 and a second weighted end cap 72 attached to opposed ends of the weighted shaft 68. Each of the end caps 70 and 72 has an outer diameter greater than the diameter of the tubular housing 60 such that the weighted shaft 68 is entrapped within the housing 60 by the pair of end caps 70 and 72. As can be understood in FIGS. 2 and 3, the length of the weighted shaft 68 between the pair of end caps 70 and 72 is substantially greater than the length of the tubular housing 60, such that the weighted shaft 68 can slide into and out of the housing 60 as the housing 60 rotates along with the shaft 48 and sprocket 54. The significance of the movement of the weighted shaft 68 into and out of the housing 60 will be described in detail below.

The safety mechanism 46 further includes a abutment 74 positioned above the speed-sensing device 58. The abutment 74 extends horizontally from a mounting brace 76 attached to one of the vertical support column 16 near its upper most end. The abutment 74 is positioned vertically above the speed-sensing device 58 at a selected distance such when the weighted shaft 68 is extended a predetermined length from the housing 60, the weighted shaft 68 contacts the abutment 74, as will be discussed in greater detail below.

Figure 5:
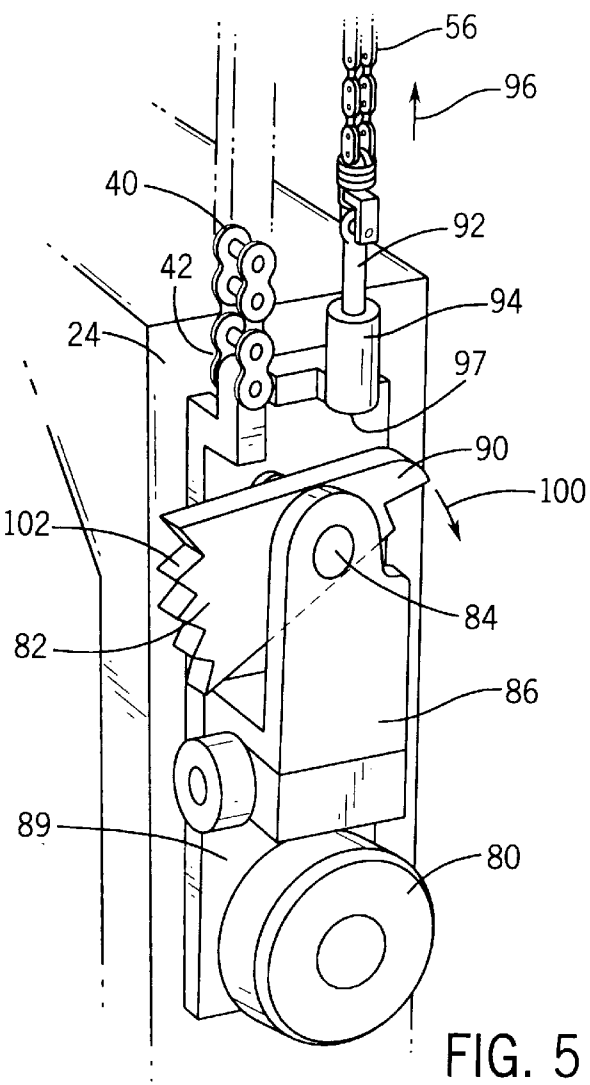
FIG. 5 is an enlarged perspective view of the locking mechanism in its engaging position.

Referring now to FIGS. 4 and 5, the safety mechanism 46 further includes a locking device 78 mounted on the wheel block assembly 44. A roller 80 guides the movement of the carriage 20 along the vertical support column 16.

The locking device 78 includes a cam 82 that is positioned to rotate about a pin 84 extending through a device 86. The cam 82 is rotatable between a non-engaging position shown in FIG. 4 and an engaging position shown in FIG. 5. A torsion spring 88 is mounted around the pin 84 and has one end attached to the cam 82 and the other end attached to the stationary mounting plate 89. The torsion spring 88 creates a bias force that urges the cam 82 into the engaging position illustrated in FIG. 5.

Referring back to FIG. 4, the cam 82 includes an extended tab 90 formed on its upper end. The tab 90 contacts the lower end of an engagement pin 92 to hold the cam 82 in the non-engaging position of FIG. 4 against the bias force generated by the torsion spring 88. Engagement pin 92 passes through a tubular housing 94 fixed to the mounting plate 89 and has its upper end attached to the safety chain 56. During normal operating conditions of the vertical conveyor 10, the lower end of the engagement pin 92 extends past the bottom end of the tubular housing 94 and engages the tab 90 to prevent the cam 82 from rotating into the engaging position.

Referring now to FIG. 5, when an upward force, as illustrated by arrow 96, is applied to the safety chain 56, the safety chain 56 pulls the engagement pin 92 upward within the housing 94. Once the engagement pin 92 passes the bottom end 97 of the housing 94, the tab 90 on the cam 82 can pass beneath the bottom end 97 of the pin such that the bias force created by the torsion spring 88 causes the cam 82 to rotate into the engaging position, as illustrated by arrow 100. When in the engaging position, the serrated teeth 102 formed on the outer end of the cam 82 engage the vertical support column 16 (not shown) to prevent further vertical movement of the carriage 20 relative to the vertical support columns 16.

OPERATION

When the carriage 20 is at the lower level 12, as illustrated in FIG. 1, the carriage 20 can be loaded with material to be moved vertically to the upper level 14. Once loaded, the drive motor 32 is activated, which causes the lift chains 40 to move the carriage 20 vertically upward along two or more spaced vertical support columns 16. As the carriage 20 moves vertically, the movement of the safety chain 56 causes the sprocket 54 and shaft 48 to rotate at a speed directly proportional to the speed of vertical movement of the carriage 20.

Figure 6:
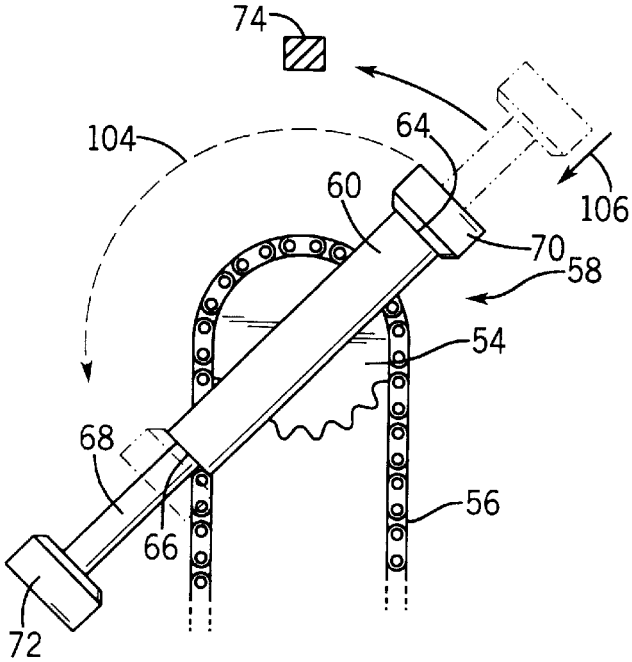
FIG. 6 is a side view illustrating the rotation of the speed-sensing device when the carriage is moving at a speed below the upper speed limit.
Figure 7:
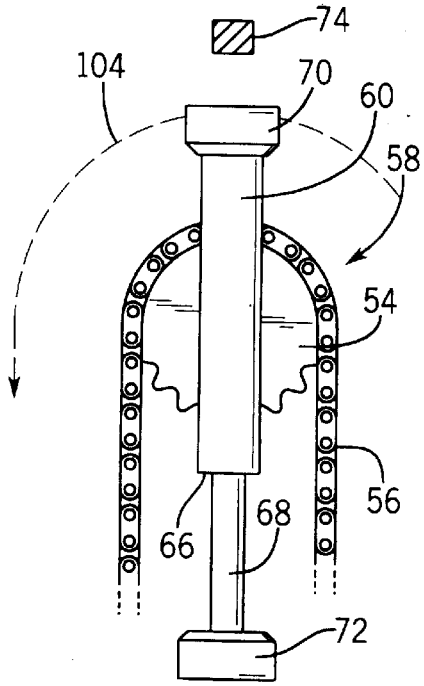
FIG. 7 is a side view illustrating the speed-sensing device passing beneath the abutment when the carriage is moving at a speed below the upper speed limit.

Referring now to FIG. 6, as the sprocket 54 rotates in the direction illustrated by arrow 104, the weight of the end cap 72 positioned below the horizontal equator extending through the pivot axis of the housing 60 causes the weighted shaft 68 to slide through the open interior of the tubular housing 60 in the direction illustrated by arrow 106 until the end cap 70 contacts the first end 64 of the tubular housing 60. If the vertical speed of the carriage 20 is slow enough, the force of gravity acting on end cap 72 will cause the weighted shaft 68 to completely extend from the second end 66 almost immediately after the end cap 72 passes below the horizontal equator extending through the pivot axis of the housing 60. After the weighted shaft 68 is completely extended below the second end 66 of the housing 60 and the end cap 70 is in contact with the first end 64 of the tubular housing 60, the sprocket 54 and housing 60 continue to rotate. As the sprocket 54 and housing 60 rotate, the end cap 70 passes beneath the abutment 74, as shown in FIG. 7, which permits the sprocket 54 to continue to rotate in direct response to the vertical movement of the carriage 20.

During normal operating conditions, the vertical speed of movement of the carriage 20 is slow enough such that the weighted shaft 68 extends below the tubular housing 60 prior to the upper end cap passing beneath the abutment 74. Thus, during normal operating situations, the speed-sensing device 58 allows the vertical reciprocating conveyor 10 to operate in a normal manner.

Figure 8:
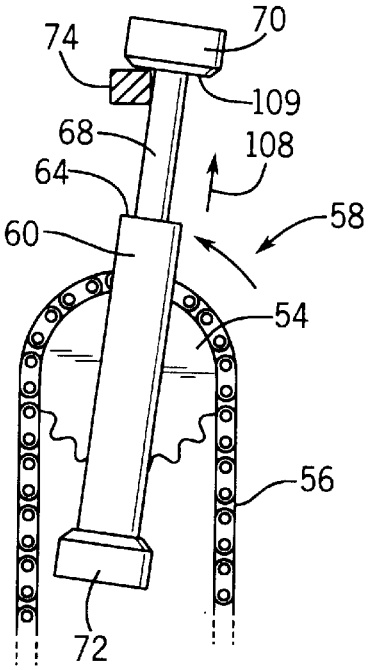
FIG. 8 is a side view illustrating the operation of the speed-sensing device to prevent further rotation of the sprocket and safety chain and thus release the locking device from the non-engaging position to the engaging position.

Referring now to FIG. 8, if the vertical speed of movement of the carriage 20 exceeds an upper speed limit, such as during the uncontrolled descent of the carriage in response to a failure of either the drive motor 32 or the lift chains 40, the housing 60 will also rotate at an increased speed. As the housing 60 rotates at an increased speed, a portion of the weighted shaft 68 remains extended from the housing 60 over an angle of rotation after the end cap rotates upward past the horizontal equator passing through the pivot axis of the housing 60. As the speed of the housing rotation continues to increase, the weighted shaft 68 remains extended from the first end 64 of the housing for a larger angle of rotation past the horizontal equator until the speed rotation of the housing 60 reaches the upper speed limit. When the speed of rotation reaches the upper speed limit, the weighted shaft 68 will remain extended long enough to contact the abutment 74, as shown in FIG. 8.

When the weighted shaft 68 contacts the abutment 74, as shown in FIGS. 3 and 8, the abutment 74 prevents further rotation of the sprocket 54. The shoulder 109 created by the increased outer diameter of the end cap 70 relative to the weighted shaft 68 contacts the abutment 74 and prevents the weighted shaft 68 from sliding back into the housing 60. Since the carriage 20 is still moving vertically when the weighted shaft 68 contacts the abutment 74, the stationary sprocket 54 creates the upward force 96 on the safety chain 56, as illustrated in FIG. 5. The upward force 96 generated on the safety chain 56 causes the engagement pin 92 to move upward and release the cam 82. As the cam 82 moves to the engaging position, the serrated teeth 102 formed on the cam engage an internal, side wall of the vertical support column 16 and prevents further vertical movement of the carriage 20.

The speed at which the speed-sensing device 58 will trigger the locking device 78 is determined in part by the weight of the end caps 70 positioned on the weighted shaft 68. As can be understood in FIGS. 6–8, if the weight of the end cap 70 is increased, the weighted shaft 68 will remain extended due to the centrifugal force at a lower rotational speed.

An additional determining factor of the speed at which the speed-sensing device 58 will trigger the locking device 78 is the amount of frictional interaction between the weighted shaft 68 and the interior of the housing 60. Although the speed-sensing device 58 has been described as releasing the locking device when the carriage 20 reaches an upper speed limit, the speed of the carriage 20 will either be the speed set by the drive motor 32 or will be the free-fall speed due to a failure. Thus, the specific speed at which the speed-sensing device 58 activates is not as important as the fact that the speed-sensing device 58 activates upon a free-fall of the carriage.

Figure 9:
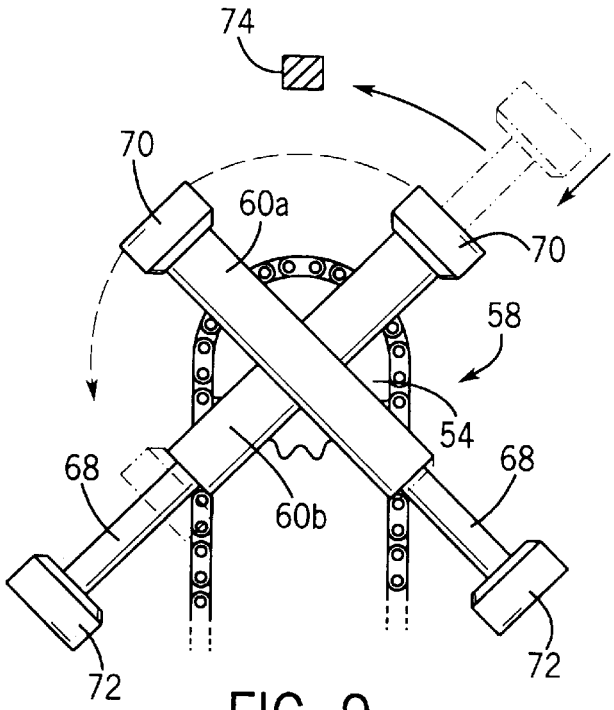
FIG. 9 is a side view illustrating an alternate embodiment of the speed-sensing device of the present invention.

As can be understood in FIGS. 8 and 9, the speed at which the weighted shaft 68 will contact the abutment 74 to prevent further rotation of the speed sensing device 58 can also be controlled by the angular position of the abutment 74 relative to the horizontal equator passing through the axis of rotation of the housing 60. In the embodiment of the invention illustrated in FIGS. 8 and 9, the abutment 74 is located at the twelve o'clock position. Thus, the force of gravity acts on the weighted shaft 68 for approximately 90° of rotation past the horizontal equator prior to the weighted shaft 68 contacting the abutment 74.

If the abutment 74 is moved to the one o'clock or two o'clock position, the weighted shaft 68 will contact the abutment 74 sooner such that the force of gravity acts on the weighted shaft 68 for a shorter period of time. Thus, the weighted shaft 68 will contact the abutment 74 at a lower speed as compared to when the abutment 74 is located at the twelve o'clock position. If the abutment is moved to the two o'clock position, as discussed above, the weighted shaft 68 will contact the abutment 74 sooner when the housing 60 rotates in the direction illustrated in FIG. 8. However, if the housing 60 is rotating in the opposite direction, the weighted shaft 68 will contact the abutment 74 later and thus at a higher speed limit. Since the purpose of the safety mechanism of the present invention is to prevent the uncontrolled descent of the carriage, the speed of rotation of the housing 60 is only critical in one direction. Thus, the angular position of the abutment 74 relative to the axis of rotation of the housing 60 is selected based on the direction of rotation of the housing 60 during uncontrolled descent of the carriage.

Another feature of the speed sensing device 58 that forms part of the present invention is that the speed sensing device 58 acts as an escapement and has a fail-safe mode of operation. If the speed sensing device 58, and specifically the housing 60 and weighted shaft 68, fail, the failure mode will result in the weighted shaft 68 extending from either the first end 64 or the second end 66 of the housing 60. Such a failure may result from particles or debris being caught between the weighted shaft and the interior of the housing or other types of common wear. The speed sensing device 58 acts as an escapement such that if the speed sensing device 58 fails, the weighted shaft 68 will remain extended and will contact the abutment 74 even though an uncontrolled descent of the carriage 20 has not occurred. The escapement therefore requires a defined movement of the weighted shaft 68 to permit normal operation of the vertical reciprocating conveyor 10 Thus, upon failure, the speed sensing device 58 acts as an escapement and releases the safety cam to lock the carriage in a fixed position along the vertical support columns 16.

In the embodiment of the invention illustrated, the speed-sensing device 58 is shown positioned on only one side of the carriage 20 and the support frame. However, it is contemplated by the inventor that the speed-sensing device 58 could be positioned on both sides of the support frame and carriage 20.

Referring now to FIG. 9, thereshown is an alternate embodiment for the speed-sensing device 58 of the present invention. In the alternate embodiment illustrated in FIG. 9, speed-sensing device 58 includes a first housing **60*a* and a second housing 60*b* positioned at right angles to each other. Each of the housings 60*a* and 60*b* include a weighted shaft 68 and a pair of end caps 70 and 72. The pair of housings 60*a* and 60*b* allow the speed-sensing device 58 to more quickly trigger the locking device 78 upon uncontrolled descent of the carriage. In the first embodiment to the invention illustrated in FIG. 8, the sprocket 54 may have to rotate 180° prior to the weighted shaft 68 extending from the housing 60 and contacting the abutment 74. By using a pair of housings positioned at right angles to each other, the sprocket 54 would only have to rotate at most 90° prior to the weighted shaft 68 contacting the abutment 74. Therefore, the use of more than one housing 60 limits the possible movement of the vertical carriage 20 prior to engagement of the locking device. Additionally, it is contemplated that more than two housings 60 could be used in the speed-sensing device 58** to further reduce the vertical movement of the carriage upon an uncontrolled descent.

Various alternatives and embodiments are contemplated as being within the scope of the following claims particularly pointing out and distinctly claiming the subject matter regarded as the invention.

I claim:

1. A safety mechanism for use on a vertical reciprocating conveyor having a carriage mounted for movement between spaced vertical support columns between two or more levels, the safety mechanism comprising:

a locking device positioned on the carriage and movable between an engaging position and a non-engaging position, wherein when the locking mechanism is in the engaging position, the carriage is prevented from moving relative to the vertical support columns; and a speed-sensing device positioned to detect the speed of movement of the carriage and operable to allow the locking device to move to the engaging position when the speed of the conveyor exceeds an upper speed limit, wherein the speed-sensing device comprises:

a housing rotatable about an axis of rotation at a rotational speed directly proportional to the speed of movement of the carriage;

a weighted shaft movable into and out of the housing as the housing rotates about the axis of rotation;

and a stationary abutment positioned above the housing, wherein the weighted shaft contacts the abutment to prevent rotation of the housing and allow the locking device to rotate into the engaging position when the speed of the carriage exceeds the upper speed limit.

2. The safety mechanism of claim 1 wherein the housing is a cylindrical tube extending between a first end and a second end.

3. The safety mechanism of claim 2 wherein the weighted shaft has a length greater than the length of the cylindrical tube between the first end and the second end.

4. The safety mechanism of claim 3 wherein the weighted shaft includes a first end and a second end, both the first end and the second end of the weighted shaft including an end cap having a diameter greater than the diameter of the cylindrical tube housing to prevent the weighted shaft from passing out of the cylindrical tube housing.

5. The safety mechanism of claim 1 wherein the housing is mounted to a shaft that is rotatably coupled to the carriage by a safety chain passing around a sprocket fixed to the shaft such that when the carriage moves along the spaced vertical support columns, the movement of the safety chain causes the sprocket to rotate the shaft and the housing about the axis of rotation.

6. The safety mechanism of claim 5 wherein the locking device includes a safety cam that is held in the non-engaging position by an engagement pin, the engagement pin being connected to one end of the safety chain such that when the weighted shaft contacts the abutment, the safety chain pulls the engagement pin from engagement with the safety cam to allow the safety cam to rotate into its engaging position.

7. A safety mechanism of claim 6 wherein the locking device further includes a bias spring connected to the safety cam to bias the safety cam into the engaging position, wherein the locking device is held in the non-engaging position against the bias force by the engagement pin.

8. A vertical reciprocating conveyor, comprising:

a frame including two or more spaced vertical support columns;

a carriage operable to carry a load and mounted for movement on the vertical support columns in a path between two or more levels;

a drive mechanism operable to move the carriage between the levels;

a locking device positioned on the carriage and movable between an engaging position and a non-engaging position, wherein where the locking mechanism is in the engaging position, the carriage is prevented from moving relative to the vertical support columns;

a speed-sensing device positioned to detect the speed of movement of the carriage and operable to allow the locking device to move to the engaging position when the speed of the conveyor exceeds an upper speed limit, wherein the speed-sensing device comprises:

a housing rotatable about an axis of rotation at a rotational speed directly proportional to the speed of movement of the carriage;

a weighted shaft movable into and out of the housing as the housing rotates about the axis of rotation; and a stationary abutment positioned above the housing, wherein the weighted shaft contacts the abutment to prevent rotation of the housing and allow the locking device to rotate into the engaging position when the speed of the carriage exceeds the upper speed limit.

9. The safety mechanism of claim 8 wherein the housing is a cylindrical tube extending between a first end and a second end.

10. The safety mechanism of claim 9 wherein the weighted shaft has a length greater than the length of the cylindrical tube between the first end and the second end.

11. The safety mechanism of claim 10 wherein the weighted shaft includes a first end and a second end, both the first end and the second end of the weighted shaft including an end cap having a diameter greater than the diameter of the cylindrical tube housing to prevent the weighted shaft from passing out of the cylindrical tube housing.

12. The safety mechanism of claim 1 wherein the housing is mounted to a shaft that is rotatably coupled to the carriage by a safety chain passing around a sprocket fixed to the shaft, such that when the carriage moves along the spaced vertical support columns, the movement of the safety chain causes the sprocket to rotate the shaft and the attached housing about the axis of rotation.

13. The safety mechanism of claim 11 wherein the locking device includes a safety cam that is held in the non-engaging position by an engagement pin, the engagement pin being connected to one end of the safety chain such that when the weighted shaft contacts the abutment, the safety chain pulls the engagement pin from engagement with the safety cam to release the safety cam to its engaging position.

14. A safety mechanism of claim 13 wherein the locking device further includes a bias spring connected to the safety cam to bias the safety cam into the engaging position, wherein the locking device is held in the non-engaging position against the bias force by the engagement pin.

15. A safety mechanism for use on a vertical reciprocating conveyor having a carriage mounted for movement along spaced vertical support columns between an upper level and a lower level, the safety mechanism comprising:

at least one locking device positioned on the carriage, the locking device including a safety cam movable between an engaging position and a non-engaging position, the safety cam being held in the non-engaging position against a bias force created by a bias spring by the engagement of the safety cam with an engagement pin;

a housing mounted to a shaft that is rotatably coupled to the carriage by a safety chain that passes around a sprocket fixed to the shaft, such that when the carriage moves along the spaced vertical support columns, the movement of the safety chain causes the sprocket to rotate the shaft and the attached housing about an axis of rotation at a speed directly proportional to the speed of movement of the carriage;

a weighted shaft movable into and out of the tubular housing as the housing rotates about the axis of rotation, the weighted shaft including a first end and a second end, the first end and the second end of the weighted shaft including an end cap having a diameter greater than the diameter of the tubular housing to prevent the weighted shaft from passing out of the tubular housing; and a stationary abutment positioned above the housing, wherein when the carriage exceeds an upper speed limit, the weighted shaft contacts the abutment to prevent rotation of the sprocket and tubular housing, thereby causing the safety chain to disengage the engagement pin and release the safety cam from the non-engaging position to the engaging position.

16. A speed sensing device for use on a vertical reciprocating conveyor having a movable carriage, comprising:

a housing extending along a longitudinal axis between spaced ends, the housing being rotatable about an axis of rotation perpendicular to the longitudinal axis;

a weighted shaft slidable into and out of the housing as the housing rotates about the axis of rotation; and a stationary abutment positioned above the housing, wherein the weighted shaft must slide into the housing to permit the housing to pass beneath the abutment and continue rotating about the axis of rotation.

17. The speed sensing device of claim 16 wherein the axis of rotation is horizontal such that the weighted shaft slides into and out of the housing due to gravity as the housing rotates.

18. The speed sensing device of claim 17 wherein the weighted shaft has a length greater than the length of the housing and includes a pair of end caps attached to opposite ends of the weighted shaft, each end cap having a diameter greater than the diameter of the tubular housing to prevent the weighted shaft from passing through the tubular housing.

19. The speed sensing device of claim 18 wherein when the tubular housing rotates about the axis of rotation at a speed below the upper speed limit, the weighted shaft slides through the tubular housing and extends below the housing to permit the housing to pass beneath the abutment.

20. The speed sensing device of claim 19 wherein the weighted shaft extends from the housing and contacts the abutment to prevent further rotation of the housing when the speed of rotation of the housing exceeds an upper speed limit.

21. An escapement, comprising:

a housing extending along a longitudinal axis between spaced ends, the housing being rotatable about an axis of rotation perpendicular to the longitudinal axis;

a weighted shaft slidable into and out of the housing as the housing rotates about the axis of rotation; and a stationary abutment positioned above the housing, wherein the weighted shaft must slide into the housing to permit the housing to pass beneath the abutment and continue rotating about the axis of rotation.

22. The escapement of claim 21 wherein the axis of rotation is horizontal such that the weighted shaft slides into and out of the housing due to gravity as the housing rotates.

23. The escapement of claim 22 wherein the weighted shaft has a length greater than the length of the housing and includes a pair of end caps attached to opposite ends of the weighted shaft, each end cap having a diameter greater than the diameter of the tubular housing to prevent the weighted shaft from passing through the tubular housing.

24. The escapement of claim 23 wherein when the tubular housing rotates about the axis of rotation at a speed below the upper speed limit, the weighted shaft slides through the tubular housing and extends below the housing to permit the housing to pass beneath the abutment.

25. The escapement of claim 24 wherein the weighted shaft extends from the housing and contacts the abutment to prevent further rotation of the housing when the speed of rotation of the housing exceeds an upper speed limit.

* * * * *